US012648626B2

(12) United States Patent
Yuan et al.

(10) Patent No.: US 12,648,626 B2
(45) Date of Patent: Jun. 9, 2026

(54) FASTENING ASSEMBLY, CONNECTING STRAP ASSEMBLY, AND WEARABLE DEVICE

(71) Applicant: Huawei Technologies Co., Ltd., Shenzhen (CN)

(72) Inventors: Shenglan Yuan, Dongguan (CN); Junjie Yang, Dongguan (CN); Bin Zhang, Dongguan (CN); Tianyu Cheng, Dongguan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 16 days.

(21) Appl. No.: 18/578,981

(22) PCT Filed: Jul. 11, 2022

(86) PCT No.: PCT/CN2022/104926

§ 371 (c)(1),
(2) Date: Jan. 12, 2024

(87) PCT Pub. No.: WO2023/284680

PCT Pub. Date: Jan. 19, 2023

(65) Prior Publication Data

US 2024/0306777 A1 Sep. 19, 2024

(30) Foreign Application Priority Data

Jul. 13, 2021 (CN) ..... 202110787843.0

(51) Int. Cl.
*A44C 5/14* (2006.01)

(52) U.S. Cl.
CPC ..... *A44C 5/14* (2013.01)

(58) Field of Classification Search
CPC .. A44C 5/14; A44C 5/18; A44C 5/185; A44C 5/20; A44C 5/2042; Y10T 24/47; Y10T 24/4736; Y10T 24/4745; Y10T 24/4782; A44B 11/006; A44B 11/04; A44B 11/06; A44B 11/12; A44B 11/20
(Continued)

(56) References Cited

U.S. PATENT DOCUMENTS 2,552,415 A * 5/1951 Fachon ..... A44C 5/185 24/265 R
5,572,771 A * 11/1996 Kelleghan ..... A44B 11/12 24/191
(Continued)

FOREIGN PATENT DOCUMENTS

CN 201153609 Y 11/2008
CN 203016005 U 6/2013
(Continued)

*Primary Examiner* — Jack W Lavinder
(74) *Attorney, Agent, or Firm* — Conley Rose, P.C.

(57) ABSTRACT

A fastening assembly comprises: a pressing plate, a base and a rotating shaft; wherein the pressing plate is rotatively connected to the base by the rotating shaft, the pressing plate and the base are enclosed to form a passage to accommodate the first connecting strap; and a press-fit protrusion is provided on the pressing plate to press the first connecting strap in the passage; a first snap-fit part is provided on the pressing plate, and a second snap-fit part is provided on the base, fit into each other to form the snap-fit connection.

20 Claims, 8 Drawing Sheets

(58) Field of Classification Search
USPC ..... 63/3.2; 368/282
See application file for complete search history.

(56) References Cited

U.S. PATENT DOCUMENTS

| | | | | |
|---|---|---|---|---|
| 6,351,874 | B1 * | 3/2002 | Suggs | A44B 11/006 24/265 R |
| 6,711,788 | B1 * | 3/2004 | Chen | A44B 11/008 2/322 |
| 2018/0035763 | A1 * | 2/2018 | Kumuchian | A44B 11/22 |
| 2019/0365062 | A1 | 12/2019 | Kelly | |
| 2021/0068508 | A1 | 3/2021 | Muenmai | |
| 2023/0232945 | A1 * | 7/2023 | Lee | A44C 5/2071 63/3.2 |

FOREIGN PATENT DOCUMENTS

| | | | |
|---|---|---|---|
| CN | 211653415 | U | 10/2020 |
| CN | 212160723 | U | 12/2020 |
| CN | 212814815 | U | 3/2021 |
| GB | 139600 | A | 3/1920 |
| JP | 2006061571 | A | 3/2006 |
| JP | 2008279244 | A | 11/2008 |

* cited by examiner

FASTENING ASSEMBLY, CONNECTING STRAP ASSEMBLY, AND WEARABLE DEVICE

CROSS-REFERENCE TO RELATED APPLICATIONS

This is a National Stage of International Patent Application No. PCT/CN2022/104926, filed on Jul. 11, 2022, which claims priority to Chinese Patent Application No. 202110787843.0, filed on Jul. 13, 2021. Both of the aforementioned applications are hereby incorporated by reference in their entireties.

TECHNICAL FIELD

This application relates to the field of consumer electronic products, and in particular, to a fastening assembly, a connecting strap assembly, and a wearable device.

BACKGROUND

A watch (for example, a smart watch) is usually connected to a watch strap by using a tang buckle. As shown in FIG. 1, a watch strap 3 is connected to a tang buckle 1, a prong 2 is provided in the tang buckle 1, and holes 41 are provided in a watch strap 4. When the watch straps are being fastened, the watch strap 4 passes through the tang buckle 1, and the prong 2 is inserted into one of the holes 41, to fasten the watch strap 4 to the watch strap 3. In this design, each of the holes 41 in the watch strap 4 is corresponding to one size of a wrist circumference. For some users, in this design, watch straps are excessively tightened around wrists of the users when the prong 2 is inserted into a hole 41, and watch straps are excessively loosened when the prong 2 is inserted into a next hole 41. In other words, in this design, fine adjustment of a length of a watch strap cannot be achieved to suit sizes of wrist circumferences of all users. In addition, in this design with the tang buckle, a hole is to be punched up in the watch strap 4. This not only increases costs, but also reduces structural strength and structural reliability of the watch strap 4, and also affects wholeness of an exterior.

SUMMARY

This application provides a fastening assembly, a connecting strap assembly, and a wearable device, so that fine adjustment of a length of a watch strap can be achieved to adapt to a size of a wrist circumference of any user, with no need to punch up a hole on a watch strap.

According to a first aspect, this application provides a fastening assembly of a wearable device. The wearable device includes a first connecting strap, or may include a second connecting strap. When the second connecting strap is included, the first connecting strap and the second connecting strap may be respectively connected to two opposite sides of a main part of the wearable device.

The fastening assembly includes a pressing plate and a base. The pressing plate includes a first lateral part, a middle part, and a second lateral part that are sequentially connected, where both the first lateral part and the second lateral part are bent relative to the middle part, one side of the first lateral part and one side of the second lateral part each are rotatively connected to the base, the other side of the first lateral part and the other side of the second lateral part each are capable of forming a snap-fit connection to the base, the first lateral part, the middle part, the second lateral part, and the base are enclosed to form a passage, and the passage is used to accommodate the first connecting strap; and a press-fit protrusion is provided on a surface that is of the base and that faces the middle part, and/or on a surface that is of the middle part of the pressing plate and that faces the base, where the press-fit protrusion is used to press the first connecting strap in the passage.

In the solution of this application, the fastening assembly may be fastened to the second connecting strap, or the fastening assembly may be directly fastened to the first connecting strap or the main part of the wearable device. The pressing plate may be approximately a C-shaped platy structure. The middle part may be approximately rectangular and flat. That both the first lateral part and the second lateral part are bent relative to the middle part may mean that the first lateral part and the second lateral part are bent, or that at least one of the first lateral part and the second lateral part may be roughly a flat structure, and there is an included angle between the flat structure and the middle part. The snap-fit connection is a detachable connection. The press-fit protrusion may be provided on at least one of the base and the middle part.

In the solution of this application, when the pressing plate rotates relative to the base to be open relative to the base, the first connecting strap may pass through between the pressing plate and the base. After the first connecting point passes through a specific distance, the pressing plate may be pressed for rotation, so that the pressing plate engages with the base. Because of the design of the press-fit protrusion, the pressing plate and the base may tighten the first connecting strap, so that the first connecting strap can be reliably fastened to the fastening assembly.

The solution of this application can be used for a size of a wrist circumference of any user. For users with different sizes of wrist circumferences, only a distance that the first connecting strap passes through the passage needs to be adjusted, so that a circumference diameter of the first connecting strap (when there is no second connecting strap) or a circumference diameter of the first connecting strap and second connecting strap (when there is the second connecting strap) can adapt to a wrist circumference of a user. In addition, the solution of this application can implement continuous adjustment and fine adjustment of a length of a watch strap, unlike a conventional design in which merely discontinuous adjustment and rough adjustment can be achieved. In addition, in the solution of this application, a hole does not need to be punched up on an exterior part of the first connecting strap, so that not only structural strength can be ensured, but also wholeness of the exterior can be improved.

In an implementation of the first aspect, a first snap-fit part is provided on a surface that is of the base and that faces the first lateral part, and a second snap-fit part is provided on a surface that is of the first lateral part and that faces the base, where one of the first snap-fit part and the second snap-fit part is a locking protrusion, the other is a locking groove, and the locking protrusion and the locking groove fit into each other to form the snap-fit connection.

In this implementation, the locking protrusion can be inserted into the locking groove, and forms a detachable snap-fit connection to the locking groove. In this design, there is a simple structure, low costs, great connection strength, and high reliability.

In an implementation of the first aspect, a surface of the locking protrusion is an arc-shaped surface, and an orthographic projection of the locking protrusion on a design surface of the locking protrusion is obround.

In this implementation, the design surface is a surface on which the locking protrusion is formed. For example, when the locking protrusion is on the surface that is of the base and that faces the first lateral part, the design surface is the surface. The design of a straight side in the obround shape of the locking protrusion helps to increase an area for fastening and ensure the connection strength. The design of an arc-shaped side in the obround shape helps to ensure moderate resistance for fastening or separation, so that travel of the locking protrusion snapping into the locking groove or travel of the locking protrusion separating from the locking groove is smooth.

In an implementation of the first aspect, an orthographic projection of the press-fit protrusion on a design surface of the press-fit protrusion is obround, and a surface of the press-fit protrusion is an arc-shaped surface; or an orthographic projection of the press-fit protrusion on a design surface of the press-fit protrusion is a rounded rectangle, and a surface of the press-fit protrusion includes an arc-shaped surface and a flat surface, where an orthographic projection of the flat surface is a shorter straight side of the rounded rectangle.

In this implementation, the design surface is a surface on which the press-fit protrusion is formed. For example, when the press-fit protrusion is on the surface that is of the base and that faces the middle part, the design surface is the surface. The design of a straight side in the obround shape or the rounded rectangle of the press-fit protrusion helps to increase an area for press-fit and ensure strength for tightening the first connecting strap.

In an implementation of the first aspect, both the first lateral part and the second lateral part are on an outer side of the base; and the fastening assembly includes a rotating shaft, where the rotating shaft passes through the first lateral part, the base, and the second lateral part, and both the first lateral part and the second lateral part each are rotatively connected to the base by using the rotating shaft. In this design, there is a simple structure with reliable mechanism motion.

In an implementation of the first aspect, the wearable device includes the second connecting strap. The fastening assembly includes a cover plate, where the cover plate is on a side that is of the base and that is away from the middle part, and the cover plate is fixedly connected to the base, to fasten the second connecting strap between the cover plate and the base. In this design, the first connecting strap and the second connecting strap are closed in a circle to adapt to a size of a wrist circumference of a user. In addition, a reliable connection between the second connecting strap and the fastening assembly can be implemented with a simple structure design for mass production.

In an implementation of the first aspect, the second connecting strap is provided with several through holes; the fastening assembly includes a screwed fitting, a connecting column and a locating column are provided on the side that is of the base and that is away from the middle part, a screw hole is provided in the connecting column, and the cover plate is provided with several connecting holes; and the connecting column and the locating column are used to pass through different through holes in the second connecting strap, and the screwed fitting passes through the connecting holes in the cover plate and is connected to the screw hole in the connecting column, to fasten the second connecting strap between the cover plate and the base.

In this implementation, the second connecting strap is fastened to the fastening assembly by fitting the connecting column into the screwed fitting and the cover plate. In this design, the second connecting strap can be easily detached, so that a user can conveniently replace/repair the fastening assembly or the second connecting strap. In addition, the screwed fitting fits into the connecting column, but does not directly fit into the second connecting strap. This can avoid abrasion caused to the second connecting strap when the screwed fitting is mounted or removed, to help ensure a service life of the second connecting strap.

In an implementation of the first aspect, the base includes a base plate and a lateral plate, the lateral plate protrudes over a part of an edge of the base plate, the lateral plate and the base plate are enclosed to form a groove having an opening, the base plate faces the middle part, and the lateral plate is away from the middle part; the press-fit protrusion is provided on a surface that is of the base plate and that faces the middle part, both the connecting column and the locating column are provided on a bottom surface of the groove, and the opening is used to accommodate one end that is of the second connecting strap and that is provided with the through holes in the groove; and the lateral plate and the first lateral part form the rotative connection and the snap-fit connection, and the lateral plate and the second lateral part form the rotative connection and the snap-fit connection. This design gives the base a simple structure and a high ability for assembly.

According to a second aspect, this application provides a connecting strap assembly of a wearable device. The connecting strap assembly includes a first connecting strap, a second connecting strap, and the fastening assembly according to any one of the foregoing implementations. The first connecting strap passes through a passage in the fastening assembly and is tightened by a middle part and a base. The second connecting strap is fastened between a cover plate and the base that are of the fastening assembly.

According to the connecting strap assembly in this application, after passing through the passage in the fastening assembly, the first connecting strap and the second connecting strap may be closed in a circle to form a complete connecting strap. For users with different sizes of wrist circumferences, only a distance that the first connecting strap passes through the passage needs to be adjusted, so that a circumference diameter of the first connecting strap (when there is no second connecting strap) or a circumference diameter of the first connecting strap and second connecting strap (when there is the second connecting strap) can adapt to a wrist circumference of a user. In addition, the solution of this application can implement continuous adjustment and fine adjustment of a length of a watch strap, unlike a conventional design in which merely discontinuous adjustment and rough adjustment can be achieved. In addition, in the solution of this application, a hole does not need to be punched up on an exterior part of the first connecting strap, so that not only structural strength can be ensured, but also wholeness of the exterior can be improved.

In an implementation of the second aspect, the wearable device includes a main part; and the first connecting strap includes a connection end and a free end, where the connection end is used to be connected to the main part, the free end and the connection end are exposed at two opposite ends of the passage, and one side that is of a first lateral part and that is close to the connection end and one side that is of a second lateral part and that is close to the connection end each are rotatively connected to the base.

In this implementation, a location of the cover plate relative to the rotating shaft on the base is on a side away from the free end of the first connecting strap. An advantage of this design is that after the free end passes through a specific distance, a user can press down the pressing plate easily to fasten the first connecting strap; and when the first connecting strap needs to be loosened, the user can conveniently lift up the free end to lift the pressing plate. In this way, operations of pressing down the pressing plate and lifting the pressing plate comply with a user habit, and particularly convenient for a user to perform the operations with one hand.

According to a third aspect, this application provides a wearable device, including a main part and the connecting strap assembly according to any one of the foregoing implementations. The main part is connected to one end of a first connecting strap and one end that is of a second connecting strap and that is away from a fastening assembly.

In this application, the main part is a main functional part of the wearable device and may include a housing and several components mounted in the housing (or on the housing). The several components may include a display, an electronic device, a circuit board component, and a structural member. The display may be electrically connected to the circuit board component for display (and may further implement a touch control function). The electronic device may be electrically connected to the circuit board component to implement a corresponding function. The structural member may have functions such as bearing, locating, structure strengthening, and receiving a pressing or rotation operation of a user (for example, the structural member may be a crown). The connecting strap assembly may be connected to the housing of the main part. The solution of this application can implement continuous and fine adjustment of a length of the connecting strap, can ensure structural strength of the connecting strap, and can improve wholeness of an exterior of the connecting strap.

In an implementation of the third aspect, the wearable device is a smart watch, and the main part is a watch head of the smart watch. In this implementation, both the first connecting strap and the second connecting strap are watch straps. The solution in this implementation can implement continuous and fine adjustment of lengths of the watch straps, can ensure structural strength of the watch straps, and can improve wholeness of an exterior of the watch straps.

DESCRIPTION OF EMBODIMENTS

The following embodiments of this application provide a wearable device, including but not limited to a smart watch, a smart band, and an electronic sphygmomanometer. A position at which the wearable device is worn on a human includes but is not limited to a wrist and an arm. The wearable device in the following embodiments may be a smart watch, and may be worn on a wrist.

Figure 1:
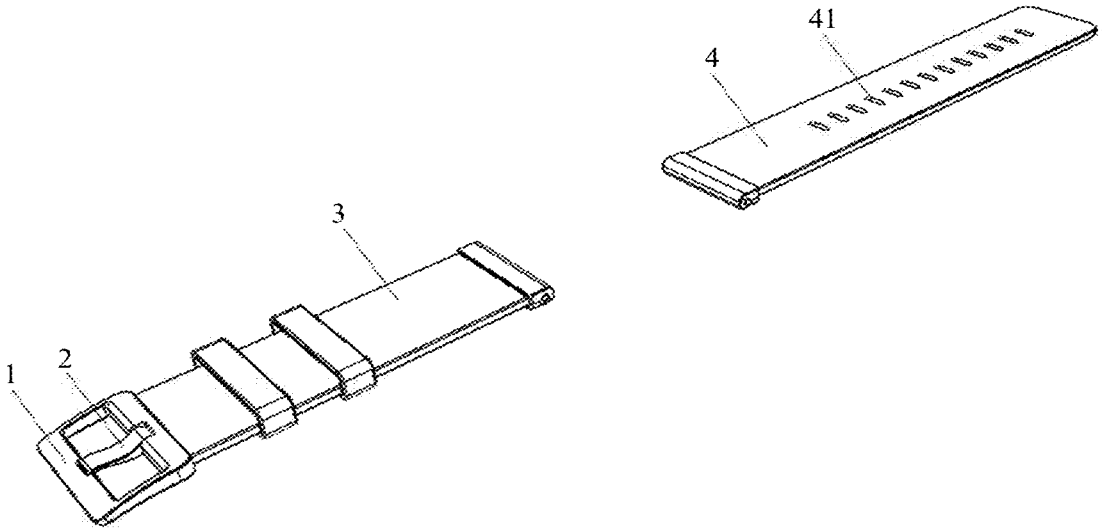
PRIOR ART FIG. 1
FIG. 1 shows a structure of a conventional watch strap.
Figure 2:
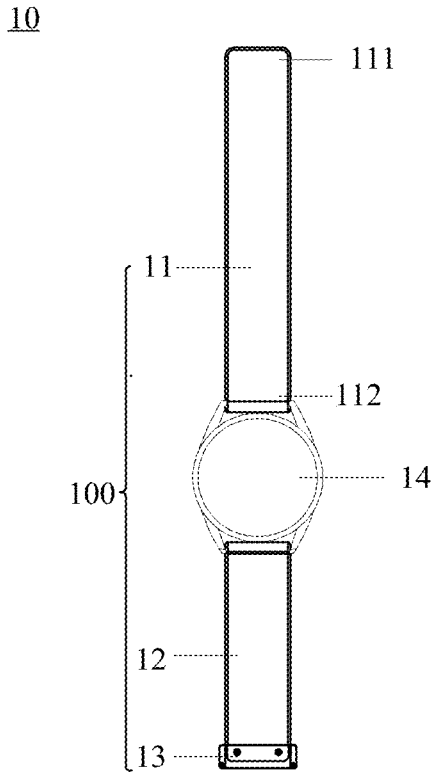
FIG. 2 is a schematic top view of a structure of a wearable device according to an embodiment.

As shown in FIG. 2, a wearable device 10 according to an embodiment may include a main part 14 and a connecting strap assembly 100. The connecting strap assembly 100 may include a first connecting strap 11, a second connecting strap 12, and a fastening assembly 13.

The main part 14 is a main functional part of the wearable device 10 and may include a housing and several components mounted in the housing (or on the housing). The several components may include a display, an electronic device, a circuit board component, and a structural member. The display may be electrically connected to the circuit board component for display (and may further implement a touch control function). The electronic device may be electrically connected to the circuit board component to implement a corresponding function. The structural member may have functions such as bearing, locating, structure strengthening, and receiving a pressing or rotation operation of a user (for example, the structural member may be a crown). When the wearable device 10 is a smart watch, the main part 14 may be referred to as a watch head.

In the connecting strap assembly 100, the first connecting strap 11 and the second connecting strap 12 are respectively connected to two opposite ends of the main part 14, and a length of the first connecting strap 11 may be greater than a length of the second connecting strap 12. The fastening assembly 13 is fastened to one end that is of the second connecting strap 12 and that is away from the main part 14. Two opposite ends of the first connecting strap 11 may be respectively referred to as a free end 11 and a connection end 112. The connection end 112 is connected to the main part 14 and may rotate relative to the main part 14. The free end 111 is used to pass through the fastening assembly 13, so that the first connecting strap 11 and the second connecting strap 12 are closed in a circle. After the free end Ill passes through a specific distance, the first connecting strap 11 may be tightened by using the fastening assembly 13. This enables the first connecting strap 11 and the second connecting strap 12 to be fastened, and the connecting strap assembly 100 to reliably surround a wrist of a user.

Figure 3:
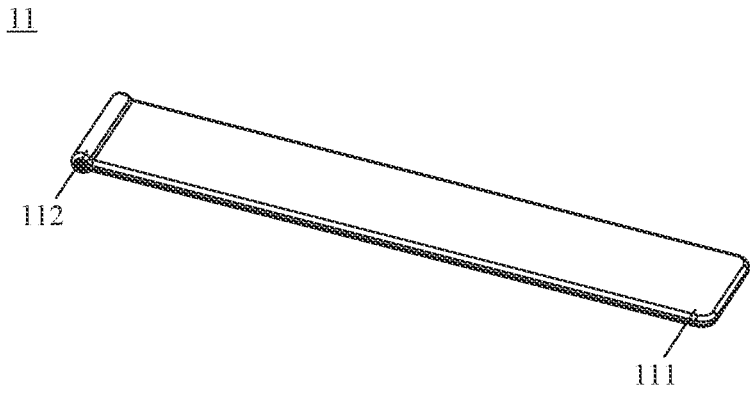
FIG. 3 is a schematic three-dimensional diagram of a structure of a first connecting strap of the wearable device in FIG. 2.

FIG. 3 may represent a structure of the first connecting strap 11 in a flattened state. As shown in FIG. 3, the first connecting strap 11 may be roughly rectangular and strip-shaped (or plate-shaped), and a rotating shaft may be provided at the connection end 112 to be rotatively connected to the main part 14. No through hole (a through hole of which an axis is in a thickness direction of the first connecting strap 11) is provided in the first connecting strap 11, showing a complete and whole look.

The first connecting strap 11 is soft and easily deformed, for example, may be a woven nylon strap or a woven polyester strap: may be a soft rubber strap, for example, a soft rubber strap made of fluoro rubber, silica gel, or thermoplastic polyurethanes (Thermoplastic polyurethanes, TPU); or may be a leather strap.

Figure 4:
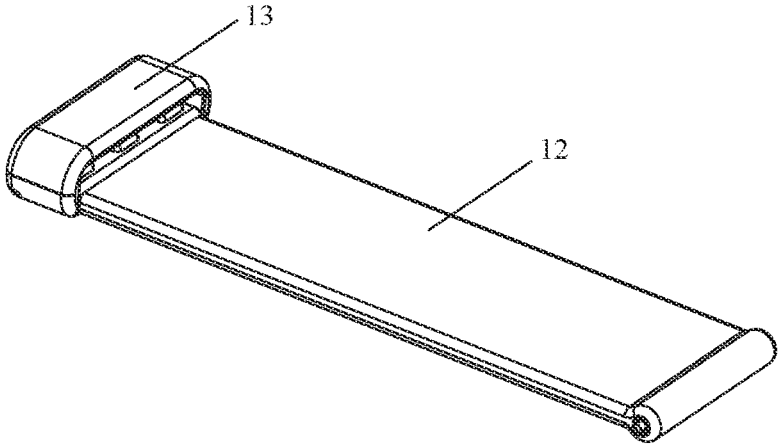
FIG. 4 is a schematic diagram of an assembly structure of a second connecting strap and a fastening assembly of the wearable device in FIG. 2 from an angle of view.
Figure 5:
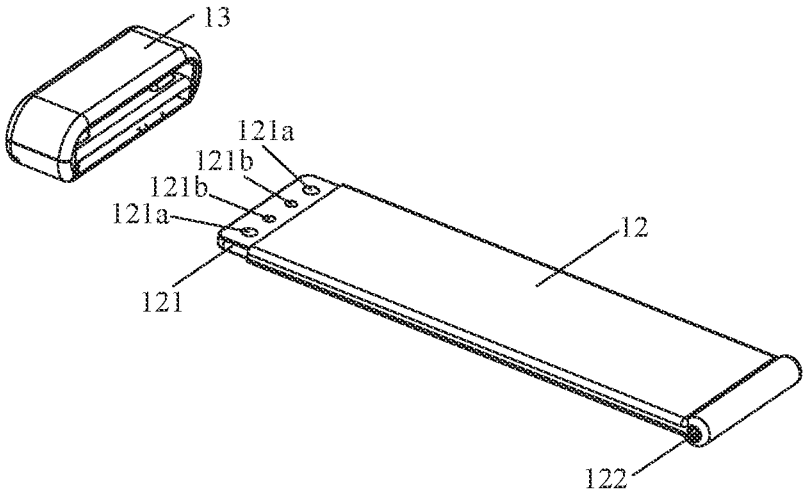
FIG. 5 is a schematic diagram of a disassembled structure of the assembly structure of the second connecting strap and the fastening assembly in FIG. 4.

FIG. 4 and FIG. 5 may represent an assembly structure of the fastening assembly 13 and the second connecting strap 12, and the second connecting strap 12 is in a flattened state.

As shown in FIG. 4 and FIG. 5, the second connecting strap 12 may be roughly rectangular and strip-shaped (or plate-shaped). Two opposite ends of the second connecting strap 12 may be respectively referred to as a matching end 121 and a connection end 122. The matching end 121 is provided with several through holes (an axis of the through holes is in a thickness dimension of the second connecting strap 12). For example, two through holes 121*a* and two through holes 121*b* are provided. The two through holes 121*b* may be schematically located between the two through holes 121*a*, and a diameter of the through holes 121*a* may be greater than a diameter of the through holes 121*b*. The through holes 121*a* and the through holes 121*b* are used to fit into the fastening assembly 13 (further described below). A structure and a quantity of through holes at the matching end 121 may be designed based on an actual requirement, and the foregoing description is merely an example. The connection end 122 is used to be connected to the main part 14, and a rotating shaft may be provided at the connection end 122, to be rotatively connected to the main part 14.

With reference to FIG. 5 and FIG. 4, the matching end 121 is connected to the fastening assembly 13, and the through holes provided at the matching end 121 are blocked by the fastening assembly 13. A remaining part, other than the matching end 121, of the second connecting strap 12 is an exterior part that can be directly seen by a user, and no through hole is provided on the exterior part. Therefore, the exterior part shows a complete and whole look.

The second connecting strap 12 is soft and easily deformed, for example, may be a woven nylon strap or a woven polyester strap; may be a soft rubber strap, for example, a soft rubber strap made of fluoro rubber, silica gel, or thermoplastic polyurethanes; or may be a leather strap. The second connecting strap 12 and the first connecting strap 11 may be made of a same material or different materials.

As shown in FIG. 4 and FIG. 5, the fastening assembly 13 is fastened to the matching end 121 of the second connecting strap 12, and the fastening assembly 13 fits into the through holes in the matching end 121 (further described below).

Figure 6:
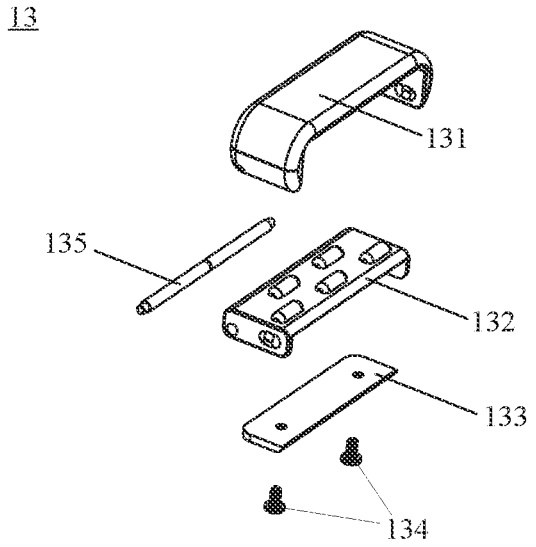
FIG. 6 is a schematic diagram of a disassembled structure of the fastening assembly in FIG. 5.

FIG. 6 is a schematic diagram of a disassembled structure of the fastening assembly 13. As shown in FIG. 6, the fastening assembly 13 may include a pressing plate 131, a base 132, a cover plate 133, a screw 134, and a rotating shaft 135. Each of the parts is described below.

Figure 7:
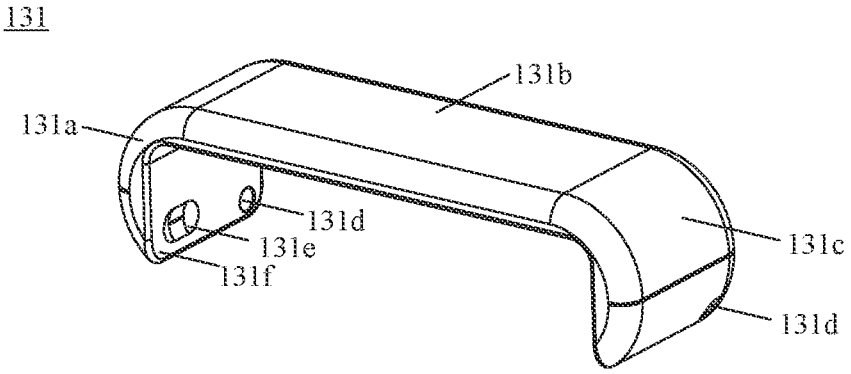
FIG. 7 is a schematic diagram of a structure of a pressing plate in the fastening assembly in FIG. 6.

As shown in FIG. 7, the pressing plate 131 may be approximately a C-shaped platy structure. The pressing plate 131 may include a middle part 131*b*, and a first lateral part 131*a* and a second lateral part 131*c* that are connected to two opposite ends of the middle part 131*b*. The middle part 131*b* may be approximately rectangular and flat. Both an outer surface of the first lateral part 131*a* and an outer surface of the second lateral part 131*c* may be approximately arc-shaped (for example, an arc, an elliptic arc, or another curve arc), and both an inner surface of the first lateral part 131*a* and an inner surface of the second lateral part 131*c* may be flat surfaces. The first lateral part 131*a* and the second lateral part 131*c* are bent towards a same side (for example, a lower side in FIG. 7) in a thickness direction of the middle part 131*b*. Both the first lateral part 131*a* and the second lateral part 131*c* may be in smooth transition to the middle part 131*b*.

In this embodiment, that the first lateral part 131*a* and the second lateral part 131*c* are bent may be described as that both are bent relative to the middle part 131*b*. In another embodiment, at least one of the first lateral part 131*a* and the second lateral part 131*c* may be roughly a flat structure, and there is an included angle between the flat structure and the middle part 131*b*. This case is also described as that the first lateral part 131*a* and the second lateral part 131*c* are bent relative to the middle part 131*b*.

As shown in FIG. 7, a locking groove 131*e* may be provided on one side of an inner surface 131*f* of the first lateral part 131*a*. An inner surface of the locking groove 131*e* may be an arc-shaped surface (the arc-shaped surface in this embodiment complies with the following definition), and the arc-shaped surface may be a part of a surface of a sphere, an ellipsoid, or a cylinder, or another mathematical surface (for example, a hyperboloid or a hyperbolic paraboloid). An orthographic projection of the locking groove 131*e* on the inner surface 131*f* (the inner surface 131*f* may also be referred to as a design surface of the locking groove 131*e*, that is, a surface on which the locking groove 131*e* is designed) may be obround (the obround shape in this embodiment complies with the following definition), and the obround shape may also be referred to as a racetrack shape that is formed with two straight lines and two arcs, where the two straight lines are parallel and equal in length, each of the arcs is tangent to the two straight lines, and the two arcs may have roughly the same shape. That "the two straight lines are parallel and equal in length" allows an error, that is, there may be an error within a tolerance range of a depth of parallelism or a length of the two straight lines. Each of the arcs may mean an arc, an elliptic arc, or another mathematical curve (for example, a logarithmic curve, a sinusoid, or an involute). A locking groove may also be provided on the inner surface (spaced from and opposite the inner surface 131*f*) of the second lateral part 131*c*, and a structure of the locking groove may be roughly the same as that of the locking groove 131*e*.

When the pressing plate 131 is assembled with the base 132, the inner surface 131*f* of the first lateral part 131*a* faces the base, and the locking groove 131*e* fits into a locking protrusion on the base 132 (further described below). Similarly, the inner surface of the second lateral part 131*c* also faces the base, and the locking groove on the inner surface also fits into a locking protrusion on the base 132 (further described below).

As shown in FIG. 7, a through hole 131*d* may be provided on the first lateral part 131*a*, and the through hole 131*d* may be spaced from the locking groove 131*e*, where the through hole 131*d* and the locking groove 131*e* may be respectively on two sides of the first lateral part 131*a*. A through hole 131*d* may also be provided on the second lateral part 131*c*, and the through hole 131*d* on the second lateral part 131*c* may be spaced from the locking groove on the second lateral part 131*c*, where the through hole 131*d* and the locking groove may be respectively on two sides of the second lateral part 131*c*. The through hole 131*d* is configured to fit into the rotating shaft 135. For example, the first lateral part 131*a* and the structures on the first lateral part 131*a*, and the second lateral part 131*c* and the structures on the second lateral part 131*c* may be symmetrically distributed on two sides of the middle part 131*b*.

Figure 8:
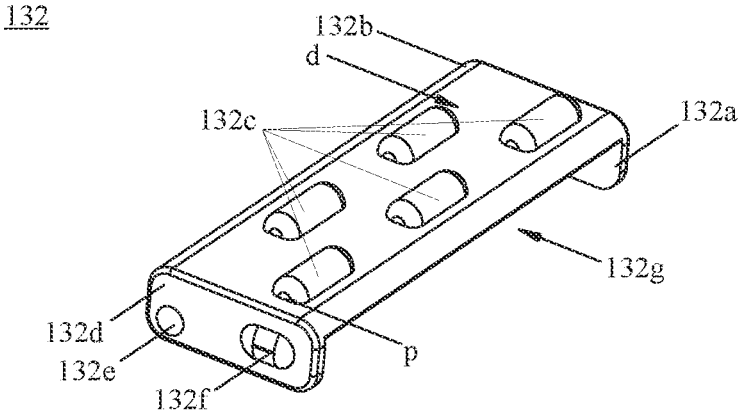
FIG. 8 is a schematic diagram of a structure of a base in FIG. 6 from an angle of view.
Figure 9:
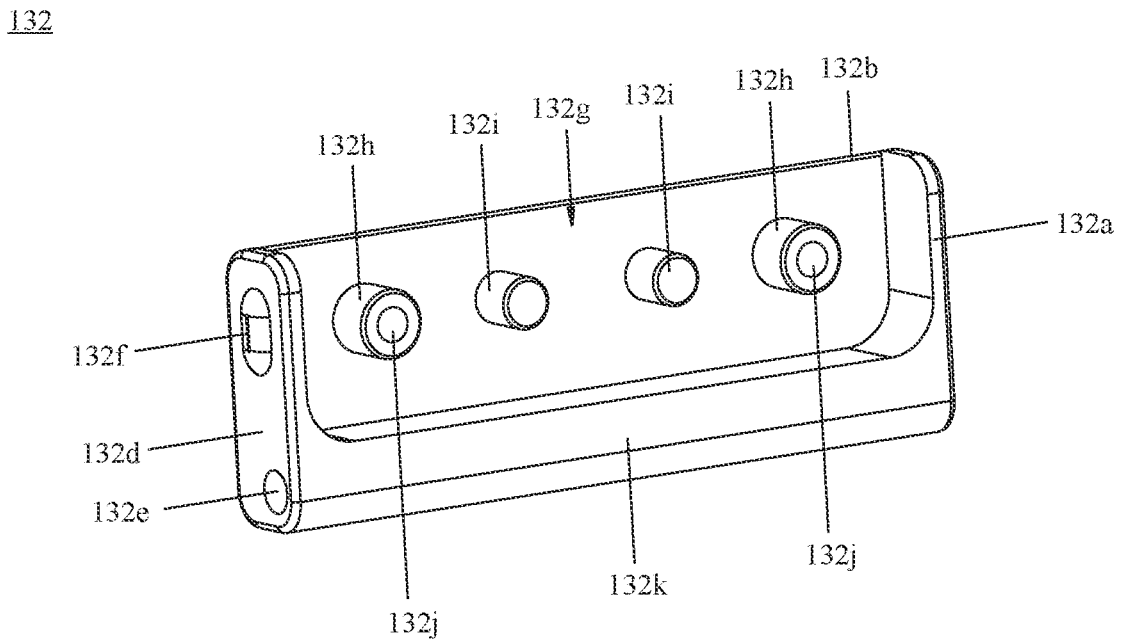
FIG. 9 is a schematic diagram of a structure of a base in FIG. 6 from another angle of view.

As shown in FIG. 8 and FIG. 9, the base 132 may include a first lateral plate 132*a*, a second lateral plate 132*k*, a third lateral plate 132*d*, and a base plate 132*b*. The base plate 132*b* may be approximately rectangular and flat. The first lateral plate 132*a*, the second lateral plate 132*k*, and the third lateral plate 132*d* are sequentially connected, and the three plates are respectively connected to three sides of the base plate 132*b*. The first lateral plate 132*a*, the second lateral plate 132*k*, and the third lateral plate 132*d* are all perpendicular to a same larger surface of the base plate 132*b* (the larger surface is a surface, in which a normal is located, along a thickness direction of the base plate 132*b*). The first lateral plate 132*a* and the third lateral plate 132*d* may have a smaller thickness, and the second lateral plate 132*k* may have a larger thickness.

In this embodiment, a structure formed by enclosing the first lateral plate 132*a*, the second lateral plate 132*k*, and the third lateral plate 132*d* may be referred to as a lateral plate. The lateral plate is located at an edge of the base plate 132*b*. As shown in FIG. 9, the lateral plate extends only along a part of the edge of the base plate 132*b*, and does not form an enclosed shape. Therefore, the lateral plate and the base plate 132*b* may be enclosed to form a groove 132*g* having an opening.

As shown in FIG. 8, several press-fit protrusions 132*c* are provided on a larger surface d that is of the base plate 132*b* and that is away from the groove 132*g*. A quantity of press-fit protrusions 132*c* may be designed based on a requirement, for example, may be 5. A manner of arranging the press-fit protrusions 132*c* may be designed based on a requirement, for example, may be divided into two columns, where one press-fit protrusion 132*c* in one column is between two adjacent press-fit protrusions 132*c* in the other column. The foregoing arrangement manner has a regularity. Clearly, the press-fit protrusions 132*c* may alternatively be arranged irregularly.

Figure 10:
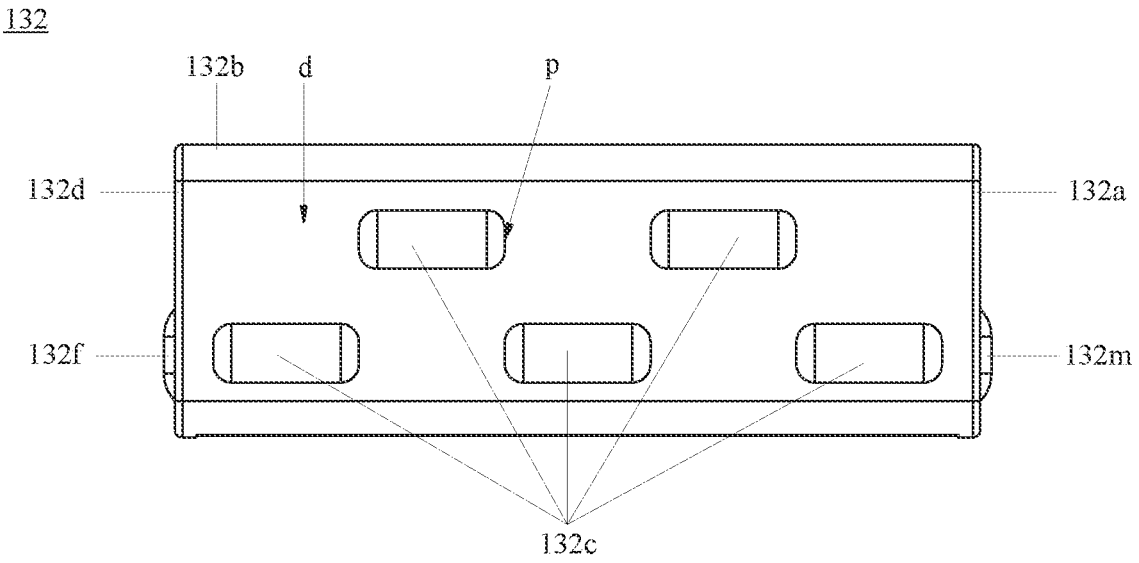
FIG. 10 is a schematic top view of a structure of the base in FIG. 8.

As shown in FIG. 8 and FIG. 10, the press-fit protrusions 132*c* may be approximately semi-cylinders, and heights of the semi-cylinders are greater than a diameter of bottom surface. Most surfaces of the press-fit protrusions 132*c* may be arc-shaped surfaces, and there may be a small flat surface p at each end of each press-fit protrusion 132*c* in a height direction. The foregoing is merely an example. Actually, the flat surface p may be replaced with an arc-shaped surface based on a product requirement. As shown in FIG. 10, an orthographic projection of each press-fit protrusion 132*c* on the larger surface d (the larger surface d may also be referred to as a design surface of the press-fit protrusion 132*c*, that is, a surface on which the press-fit protrusion 132*c* is designed) of the base plate 132*b* may be approximately a rounded rectangle, where an orthographic projection of the flat surface p is a shorter straight side of the rounded rectangle. Alternatively, when the flat surface p is replaced with an arc-shaped surface, the orthographic projection of the press-fit protrusion 132*c* on the larger surface d of the base plate 132*b* may be approximately obround.

As shown in FIG. 9, a connecting column 132*h* and a locating column 132*i* are provided on a surface that is of the base plate 132*b* and that is away from the press-fit protrusions 132*c*, or the connecting column 132*h* and the locating column 132*i* are provided on a bottom surface of the groove 132*g*. Quantities of connecting columns 132*h* and locating columns 132*i* may each be designed based on a requirement, for example, may each be two. A manner of arranging the connecting columns 132*h* and the locating columns 132*i* may be designed based on a requirement. For example, the locating columns 132*i* may be between the connecting columns 132*h*.

The connecting columns 132*h* are screwed columns, and screw holes 132*j* may be provided inside the connecting columns 132*h*. An axis of each screw hole 132*j* roughly coincides with an axis of each connecting column 132*h*. A height of each connecting column 132*h* and a height of each locating column 132*i* may both be less than a height of the lateral plate (formed by the first lateral plate 132*a*, the second lateral plate 132*k*, and the third lateral plate 132*d*), that is, a top surface of the connecting column 132*h* and a top surface of the locating column 132*i* may both be lower than a top surface of the lateral plate, so that the second connecting strap 12 and the cover plate 133 may be subsequently mounted into the groove 132*g* (further described below) conveniently. With reference to FIG. 9 and FIG. 5, when the second connecting strap 12 is mounted into the groove 132*g*, the connecting columns 132*h* fit into the through holes 121*a* in the second connecting strap 12, and the locating columns 132*i* fit into the through holes 121*b* in the second connecting strap 12.

As shown in FIG. 8 to FIG. 10, a locking protrusion 132*f* is provided on a surface that is of the third lateral plate 132*d* and that is away from the groove 132*g*, a locking protrusion 132*m* is provided on a surface that is of the first lateral plate 132*a* and that is away from the groove 132*g*, and both the locking protrusion 132*f* and the locking protrusion 132*m* are close to the opening of the groove 132*g* (that is, close to a side, of the base plate 132*b*, on which no lateral plate is provided). The locking protrusion 132*f* and the locking protrusion 132*m* may have a same structure. The locking protrusion 132*f* is used as an example for description.

As shown in FIG. 8, a surface of the locking protrusion 132*f* may be an arc-shaped surface. An orthographic projection of the locking protrusion 132*f* on the surface (that may also be referred to as a design surface of the locking protrusion 132*f*, that is, a surface on which the locking protrusion 132*f* is designed) that is of the third lateral plate 132*d* and that is away from the groove 132*g* may be obround. With reference to FIG. 7 and FIG. 8, when the base 132 is assembled with the pressing plate 131, the surface of the third lateral plate 132*d* faces the inner surface 131*f* of the first lateral part 131*a* of the pressing plate 131, and the locking protrusion 132*f* fits into the locking groove 131*e* on the inner surface 131*f* (further described below). With reference to FIG. 10 and FIG. 7, when the base 132 is assembled with the pressing plate 131, the locking protrusion 132*m* on the first lateral plate 132*a* fits into the locking groove on the inner surface of the first lateral part 131*a* of the pressing plate 131 (further described below).

In this embodiment, the locking protrusion may snap into the locking groove to form a detachable snap-fit connection. The design of a straight side in the obround shape of the locking protrusion helps to increase an area for fastening and ensure the connection strength. The design of an arc-shaped side in the obround shape helps to ensure moderate resistance for fastening or separation, so that travel of the locking protrusion snapping into the locking groove or travel of the locking protrusion separating from the locking groove is smooth.

In another embodiment, locations at which the locking protrusion and the locking groove are designed may be interchanged, that is, the locking protrusion may alternatively be provided on the inner surface 131*f* of the first lateral part 131*a* of the pressing plate 131. Correspondingly, the locking groove may alternatively be provided on the surface that is of the third lateral plate 132*d* of the base 132 and that is away from the groove 132*g*. Therefore, in embodiments of this application, one of the locking protrusion and the locking groove may be referred to as a first snap-fit part, and the other may be referred to as a second snap-fit part (the first snap-fit part is the locking protrusion, or the locking groove, and the second snap-fit part is the locking groove, or the locking protrusion). It may be considered that the first snap-fit part is provided on the base 132, and the second snap-fit part is provided on the pressing plate 131.

As shown in FIG. 8 and FIG. 9, a through hole 132*e* is provided on the base 132, and the through hole 132*e* passes through the first lateral plate 132*a*, the second lateral plate 132*k*, and the third lateral plate 132*d*. The through hole 132*e* is away from the opening of the groove 132*g*, and the locking protrusion 132*f* is close to the opening of the groove 132*g*. The through hole 132*e* may be aligned with the through hole 131*d* on the pressing plate 131, and the through hole 132*e* is configured to mount the rotating shaft 135.

Figure 11:
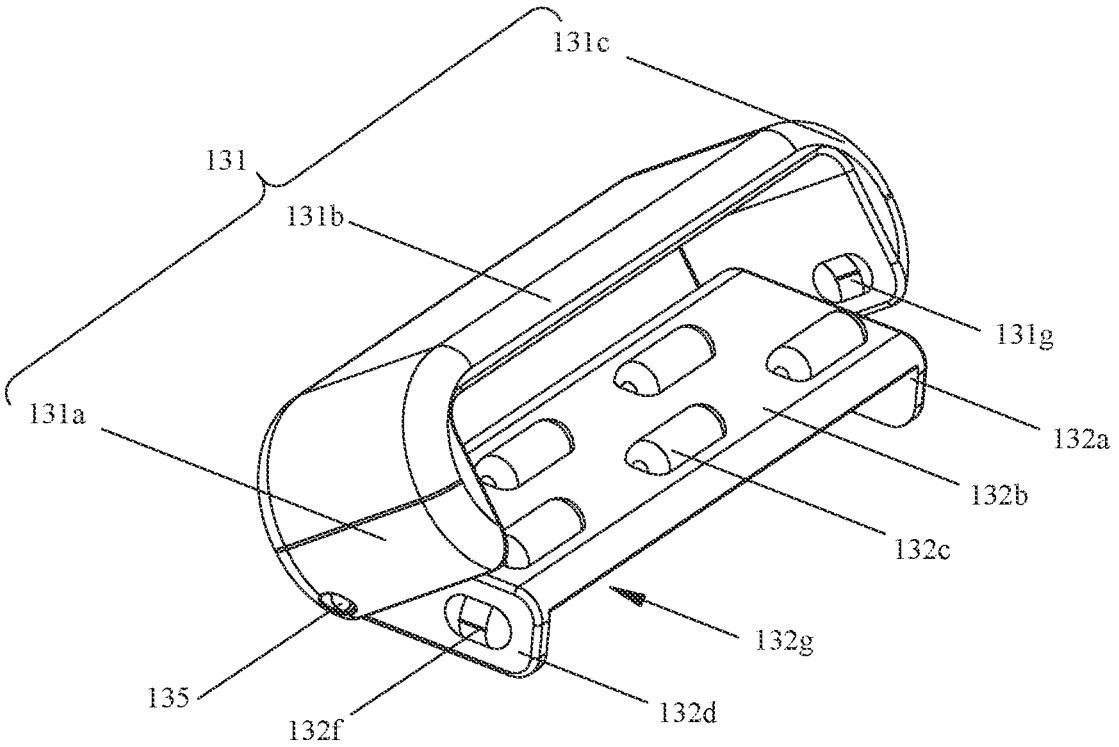
FIG. 11 is a schematic diagram of a state in which the pressing plate in FIG. 7 and the base in FIG. 8 are assembled.

FIG. 11 shows an assembly structure of the pressing plate 131, the base 132, and the rotating shaft 135. With reference to FIG. 7, FIG. 8, and FIG. 11, the pressing plate 131 may surround the base 131, the first lateral part 131*a* of the pressing plate 131 is on an outer side of the third lateral plate 132*d* of the base 132, the second lateral part 131*c* of the pressing plate 131 is on an outer side of the first lateral plate 132*a* of the base 132, and the middle part 131*b* of the pressing plate 131 may be corresponding to the base plate 132*b* of the base 132. The rotating shaft 135 may pass through the through hole 131*d* on the first lateral part 131*a*, the through hole 132*e* on the base 132, and the through hole 131*d* on the second lateral part 131*c*, so that the pressing plate 131 is rotatively connected to the base 132.

FIG. 11 represents a state of the pressing plate 131 after rotating relative to the base 132 by a specific angle. With reference to FIG. 7 and FIG. 11, the locking groove 131*g* on the second lateral part 131*c* of the pressing plate 131 is separated from the locking protrusion on the first lateral plate 132*a* of the base 132; and the locking groove 131*e* on the first lateral part 131*a* of the pressing plate 131 is separated from the locking protrusion 132*f* on the third lateral plate 132*d* of the base 132. In this case, the free end 111 of the first connecting strap 11 may be inserted between the middle part 131*b* of the pressing plate 131 and the base plate 132*b* of the base 132 from one side of the rotating shaft 135 (further described below).

When the pressing plate 131 is pressed, the locking groove 131*g* on the second lateral part 131*c* of the pressing plate 131 can form a snap-fit connection to the locking protrusion on the first lateral plate 132*a* of the base 132; and the locking groove 131*e* on the first lateral part 131*a* of the pressing plate 131 forms a snap-fit connection to the locking protrusion 132*f* on the third lateral plate 132*d* of the base 132. In this case, the middle part 131*b* of the pressing plate 131 may be spaced from and opposite the base plate 132*b* of the base 132, and the pressing plate 131 and the base 132 may form a passage. The first connecting strap 11 in the passage is to be pressed tightly by the pressing plate 131 on the press-fit protrusion 132*c* on the base 132. Therefore, the first connecting strap 11 can be reliably fastened to the fastening assembly 13.

According to the assembly principle described above, in another embodiment, the press-fit protrusion may alternatively be provided on an inner surface of the middle part 131*b* of the pressing plate 131, and the base plate 132*b* of the base 132 may not be provided with a press-fit protrusion; or press-fit protrusions may be provided on both the inner surface of the middle part 131*b* and the base plate 132*b*. Both designs can achieve the purpose of tightening the first connecting strap 11 between the pressing plate 131 and the base 132. In the another embodiment, a structure of the press-fit protrusion may be the same as the structure described above.

Figure 12:
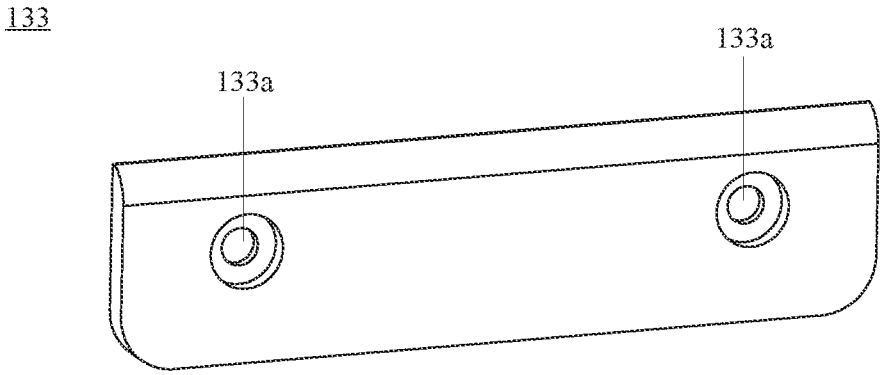
FIG. 12 is a schematic diagram of a structure of a cover plate in the fastening assembly in FIG. 6.

FIG. 12 represents a structure of the cover plate 133. As shown in FIG. 12, the cover plate 133 is roughly flat and may be provided with several connecting holes 133*a*, for example, two connecting holes 133*a*.

Figure 13:
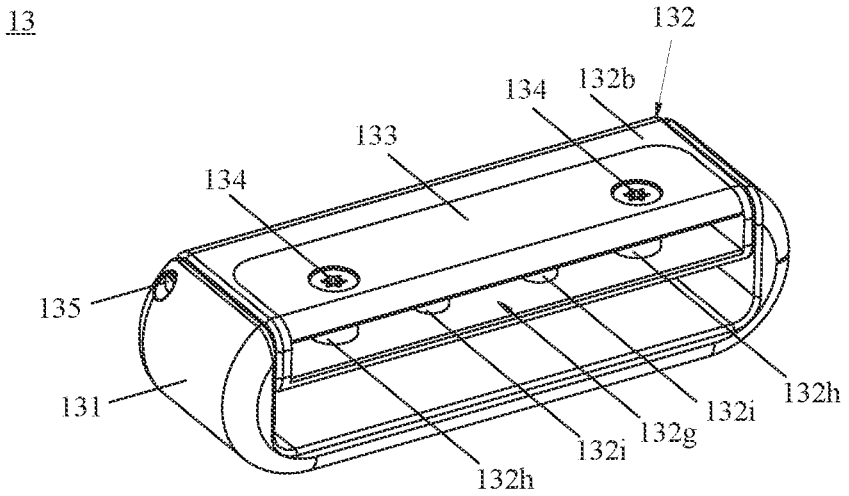
FIG. 13 is a schematic diagram of a structure of the fastening assembly in FIG. 5 from an angle of view.

FIG. 13 represents a structure of the fastening assembly 13 from another angle of view, and may also show a fit of the cover plate 133 into the base 132. As shown in FIG. 13, the cover plate 133 may cover the groove 132*g* on the base 132, and both the connecting columns 132*h* and the locating columns 132*i* in the groove 132*g* are below the cover plate 133 (the angle of view in FIG. 13 is used as an example). With reference to FIG. 12, FIG. 9, and FIG. 13, the connecting holes 133*a* on the cover plate 133 may be aligned with the screw holes 132*j* in the connecting columns 132*h* on the base 132. Screws 134 may fit into the connecting holes 133*a* and the screw holes 132*j*, to fasten the cover plate 133 to the base 132.

Figure 14:
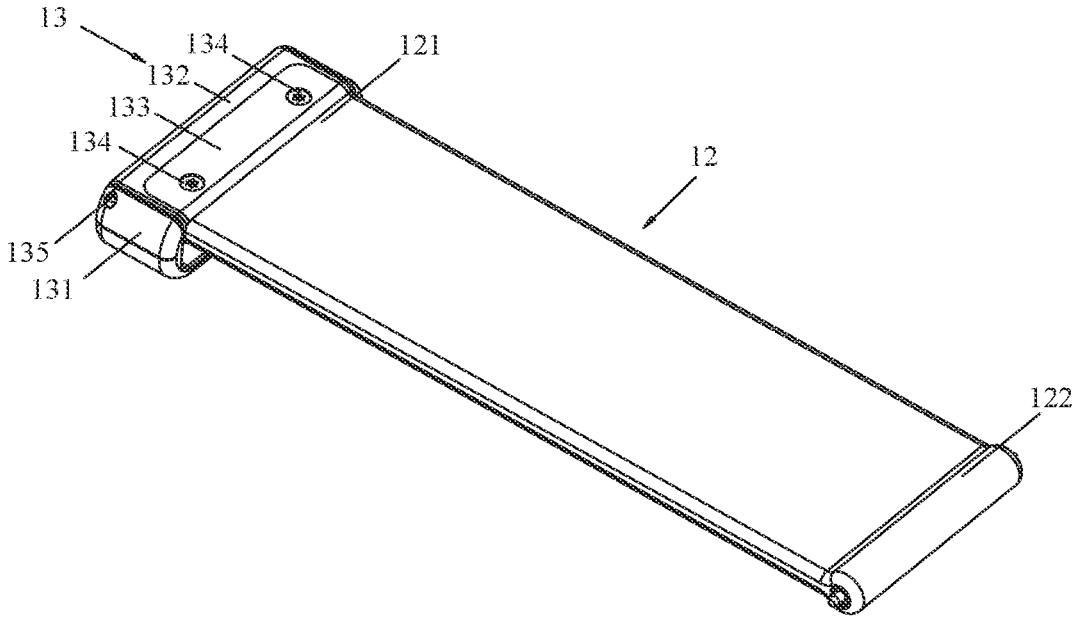
FIG. 14 is a schematic diagram of an assembly structure of the second connecting strap and the fastening assembly in FIG. 4 from another angle of view.

FIG. 14 represents an assembly structure of the second connecting strap 12 and the fastening assembly 13. With reference to FIG. 5, FIG. 13, and FIG. 14, during assembly, the matching end 121 of the second connecting strap 12 may be first placed into the groove 132*g* on the base 132, the connecting columns 132*h* in the groove 132*g* then pass through the through holes 121*a* at the matching end 121, and the locating columns 132*i* in the groove 132*g* pass through the through holes 121*b* at the matching end 121, to position the matching end in the groove 132*g*. Then, the cover plate 133 is used to cover the groove 132*g*, and the cover plate 133 is connected to the connecting columns 132*h* by using the screws 134, to fasten the cover plate 133 to the base 132, thereby fastening the matching end 121 of the second connecting strap 12 to the fastening assembly 13.

In the embodiments, the locating columns 132*i* are designed to position and limit the matching end 121 of the second connecting strap 12. In another embodiment, the locating columns 132*i* may not be provided based on a product requirement.

In the embodiments, the second connecting strap 12 is fastened to the fastening assembly 13 by fitting the connecting columns 132*h* to the screws 134 and the cover plate 133. This design easily ensures that the second connecting strap 12 is detachable, and a user can replace/maintain the fastening assembly 13 or the second connecting strap 12 conveniently. In addition, the screws 134 fit into the connecting columns 132*h*, but do not fit into the matching end 121 of the second connecting strap 12. This can avoid abrasion caused to the matching end 121 when the screws 134 are mounted or removed, to help ensure a service life of the second connecting strap 12. In another embodiment, based on a product requirement, another structure may alternatively be used to implement a fixed connection between the second connecting strap 12 and the fastening assembly 13. For example, other connecting pieces may be used to replace the screws 134, or the cover plate 133 is fastened to the groove 132*g* by using another connection structure (for example, a snap-fit structure) instead of a connecting piece. In another embodiment, the second connecting strap 12 and the fastening assembly 13 may form a detachable connection or a non-detachable connection.

Figure 15:
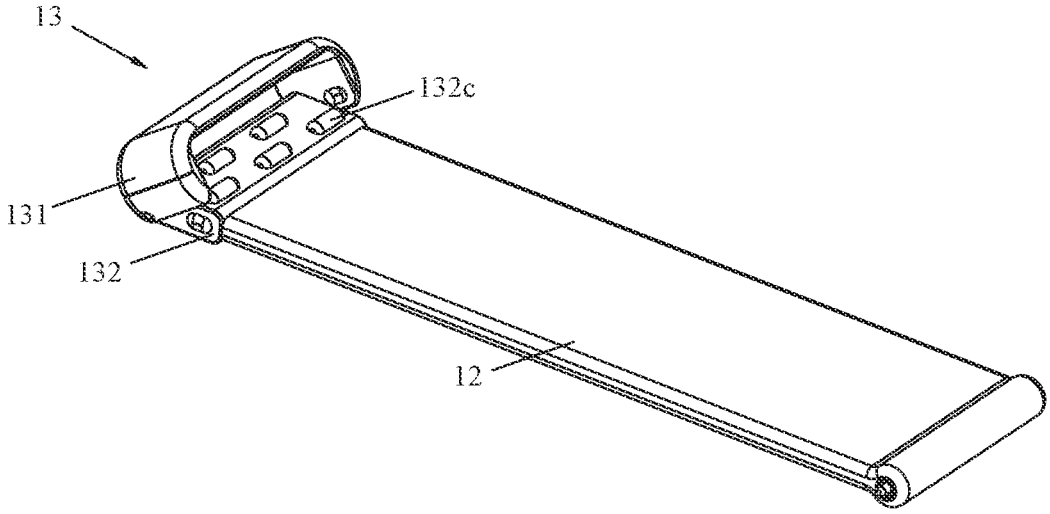
FIG. 15 is a schematic diagram of a state in which a pressing plate rotates around a fastening assembly by a specific angle for a first connecting strap to pass through the fastening assembly according to an embodiment.
Figure 16:
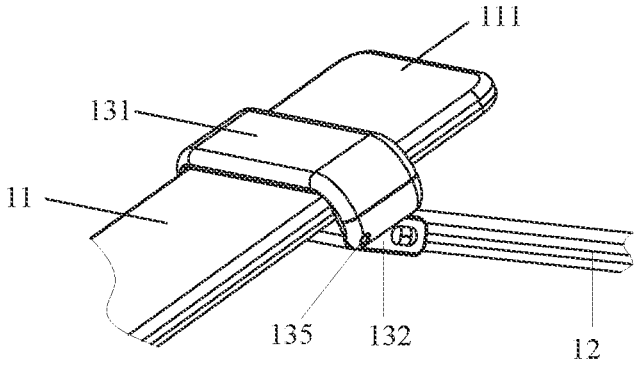
FIG. 16 is a schematic diagram of a state in which a first connecting strap passes through a fastening assembly according to an embodiment.

When the pressing plate 131 of the fastening assembly 13 rotates to be in a state shown in FIG. 15, the free end 111 of the first connecting strap 11 may pass through between the pressing plate 131 and the base 132, to close the first connecting strap 11 and the second connecting strap 12, as shown in FIG. 16. After the free end 111 passes through a specific distance, the pressing plate 131 may be pressed for rotation, so that the locking protrusions on the pressing plate 131 engage with the locking grooves on the base 132. In this case, the pressing plate 131 may press the first connecting strap 11 tightly on the press-fit protrusions 132*c* on the base 132. Held in between the pressing plate 131 and the press-fit protrusions 132*c*, the first connecting strap 11 can be reliably fastened to the fastening assembly 13, as shown in FIG. 17.

Figure 17:
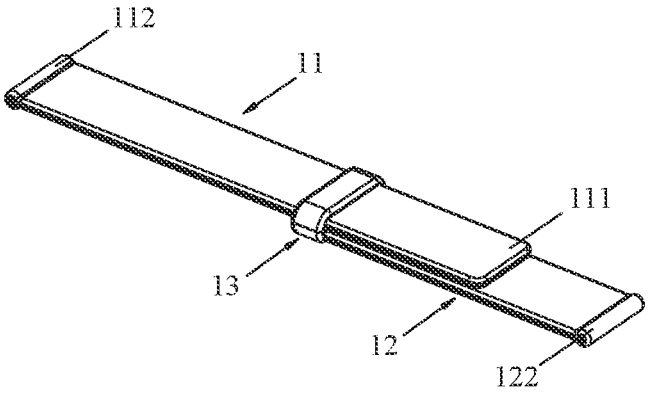
FIG. 17 is a schematic diagram of a state in which a pressing plate and a base form a snap-fit connection to tighten a first connecting strap between the pressing plate and the base according to an embodiment.

Refer to FIG. 17 and FIG. 16. When the first connecting strap 11 needs to be removed from the fastening assembly 13, the free end 111 may be lifted up to lift the pressing plate 131 (for example, to rotate the pressing plate 131 counterclockwise from an angle of view shown in FIG. 17), to unfasten the pressing plate 131 from the base 132. In this case, the first connecting strap 11 is no longer held in between the pressing plate 131 and the press-fit protrusions 132*c*, and the first connecting strap 11 may be pulled out between the pressing plate 131 and the base 132.

As shown in FIG. 16, in this embodiment, the rotating shaft 135 is mounted on a side that is of the fastening assembly 13 and that is away from the free end 111. An advantage of this design is that after the free end 111 passes through a specific distance, a user may press the pressing plate 131 (for example, rotate the pressing plate 131 clockwise from an angle of view shown in FIG. 16) smoothly to fasten the first connecting strap 11; and when the first connecting strap 11 needs to be loosened, the user may conveniently lift up the free end 111 to lift the pressing plate 131. With the foregoing design of a location of the rotating shaft 135, an operation of pressing down the pressing plate 131 and lifting the pressing plate 131 can conform to a user habit, and especially, the user can conveniently press down the pressing plate 131 and lift the pressing plate 131 with one hand. It can be understood that, based on a requirement, locations of the rotating shaft 135 and the locking protrusions/locking grooves on the fastening assembly 13 may be interchanged.

Based on the foregoing descriptions, it can be easily understood that a design for fitting the first connecting strap 11 into the fastening assembly 13 is applicable to a size of a wrist circumference of any user. For users with different sizes of wrist circumferences, only a distance through which the free end 111 passes needs to be adjusted, so that a circumference diameter (that is, a watch strap length) of the first connecting strap 11 and the second connecting strap 12 can suit a wrist circumference of a user. In addition, this design can implement continuous adjustment and fine adjustment of a length of a watch strap, unlike a conventional design in which merely discontinuous adjustment and rough adjustment can be achieved. In addition, in the solution of this embodiment, a hole does not need to be punched up on an exterior part of the first connecting strap 11 and the second connecting strap 12, so that not only structural strength can be ensured, but also wholeness of the exterior can be improved.

In conclusion, in the solution of this embodiment, the fastening assembly 13 is designed to achieve continuous and fine adjustment of a circumference diameter of the connecting straps reliably and conveniently, ensure structural strength of the connecting straps, and improve wholeness of an exterior of the connecting straps.

Different from the foregoing embodiment, in another embodiment, the connecting strap assembly of the wearable device may not include the second connecting strap, and the fastening assembly in the connecting strap assembly may be directly connected to the main part of the wearable device. The first connecting strap in the connecting strap assembly may enter a passage of the fastening assembly, and is tightened in the passage. A part of the first connecting strap that is shown outside the passage may curl up to fit the human body. According to the solution in the another embodiment, continuous and fine adjustment of the circumference diameter of the connecting straps can also be reliably and conveniently achieved, structural strength of the connecting straps can be ensured, and wholeness of an exterior of the connecting straps can be improved. In addition, because the second connecting strap is omitted, a structure is simpler, and costs can be reduced.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A watch strap comprising:

a first connecting strap;

a second connecting strap; and a fastening assembly coupled to the second connecting strap and comprising:

a rotating shaft;

a base comprising:

a first surface, wherein the first surface comprises a first snap-fit part, and wherein the first snap-fit part is a locking protrusion or a locking groove; and a second surface comprising a press-fit protrusion configured to press the first connecting strap in a passage;

a pressing plate rotatively coupled to the base by the rotating shaft and comprising a third surface comprising a second snap-fit part and facing the first surface of the base wherein the second snap-fit part is the locking protrusion when the first snap-fit part is the locking groove, wherein the second snap-fit part is the locking groove when the first snap-fit part is the locking protrusion, wherein the locking protrusion and the locking groove fit into each other to form a snap-fit connection, and wherein the pressing plate and the base are enclosed to form the passage; and a cover plate coupled to the base and configured to fasten the second connecting strap between the cover plate and the base.

2. The watch strap of claim 1, wherein the locking protrusion is an arc-shaped surface, and wherein an orthographic projection of the locking protrusion onto a design surface on which the locking protrusion is designed is obround.

3. The watch strap of claim 1, wherein the press-fit protrusion is an arc-shaped surface and an orthographic projection of the press-fit protrusion onto a design surface on which the press-fit protrusion is designed is obround.

4. The watch strap of claim 1, wherein the first surface of the base is an outer side of the base.

5. The watch strap of claim 1, wherein the pressing plate further comprises a first lateral part, a middle part, and a second lateral part that are sequentially connected, wherein the rotating shaft passes through the first lateral part, the base, and the second lateral part, and wherein both the first lateral part and the second lateral part each are rotatively coupled to the base using the rotating shaft.

6. The watch strap of claim 5, wherein the cover plate is located on a side that is of the base and that is away from the middle part.

7. The watch strap of claim 6, wherein the second connecting strap has through holes, wherein the cover plate has connecting holes, and wherein the fastening assembly comprises:

a connecting column comprising a screw hole;

a screwed fitting passing through the connecting holes, connected to the screw hole, and configured to fasten the second connecting strap between the cover plate and the base; and a locating column located on the side of the base, wherein the connecting column and the locating column pass through the through holes.

8. The watch strap of claim 7, wherein the base further comprises:

a base plate comprising an edge and a fourth surface facing the middle part, wherein the press-fit protrusion is provided on the fourth surface; and a lateral plate facing away from the middle part and protruding over the edge, wherein the lateral plate and the base plate are enclosed to form a groove having an opening, wherein both the connecting column and the locating column are provided on a bottom surface of the groove, wherein the opening accommodates one end that is of the second connecting strap and that is provided with the through holes in the groove, wherein the lateral plate and the first lateral part form a rotative connection and the snap-fit connection, and wherein the lateral plate and the second lateral part form the rotative connection and the snap-fit connection.

9. The watch strap of claim 1, wherein the press-fit protrusion is an arc-shaped surface and a flat surface and a first orthographic projection of the press-fit protrusion onto a design surface on which the press-fit protrusion is designed is a rounded rectangle, and wherein a second orthographic projection of the flat surface onto the design surface comprises a shorter straight side of the rounded rectangle.

10. A wearable device comprising:

a first connecting strap comprising a first end;

a second connecting strap comprising a second end;

a main part coupled to the first end and the second end; and a fastening assembly coupled to the second connecting strap, located away from the main part, and comprising:

a rotating shaft;

a base comprising:

a first surface, wherein the first surface comprises a first snap-fit part, and wherein the first snap-fit part is a locking protrusion or a locking groove; and a second surface comprising a press-fit protrusion configured to press the first connecting strap in a passage;

a pressing plate rotatively coupled to the base by the rotating shaft and comprising a third surface comprising a second snap-fit part and facing the first surface of the base, wherein the second snap-fit part is the locking protrusion when the first snap-fit part is the locking groove, wherein the second snap-fit part is the locking groove when the first snap-fit part is the locking protrusion, wherein the locking protrusion and the locking groove fit into each other to form a snap-fit connection, and wherein the pressing plate and the base are enclosed to form the passage; and a cover plate coupled to the base and configured to fasten the second connecting strap between the cover plate and the base.

11. The wearable device of claim 10, wherein the locking protrusion is an arc-shaped surface, and wherein an orthographic projection of the locking protrusion onto a design surface on which the locking protrusion is designed is obround.

12. The wearable device of claim 10, wherein the press-fit protrusion is an arc-shaped surface and an orthographic projection of the press-fit protrusion onto a design surface on which the press-fit protrusion is designed is obround.

13. The wearable device of claim 10, wherein the first surface of the base is an outer side of the base.

14. The wearable device of claim 10, wherein the pressing plate further comprises a first lateral part, a middle part, and a second lateral part that are sequentially connected, wherein the rotating shaft passes through the first lateral part, the base, and the second lateral part, and wherein both the first lateral part and the second lateral part each are rotatively coupled to the base using the rotating shaft.

15. The wearable device of claim 14, wherein the cover plate is located on a side that is of the base and that is away from the middle part.

16. The wearable device of claim 15, wherein the second connecting strap has through holes, wherein the cover plate has connecting holes, and wherein the fastening assembly comprises:

a connecting column has a screw hole;

a screwed fitting passes through the connecting holes and is connected to the screw hole to fasten the second connecting strap between the cover plate and the base; and a locating column located on the side of the base, wherein the connecting column and the locating column pass through the through holes.

17. The wearable device of claim 16, wherein the base further comprises:

a base plate comprising an edge and a fourth surface facing the middle part, wherein the press-fit protrusion is provided on the fourth surface; and a lateral plate located away from the middle part and protruding over the edge, wherein the lateral plate and the base plate are enclosed to form a groove having an opening, wherein both the connecting column and the locating column are provided on a bottom surface of the groove, wherein the opening accommodates one end that is of the second connecting strap and that is provided with the through holes in the groove, wherein the lateral plate and the first lateral part form a rotative connection and the snap-fit connection, and wherein the lateral plate and the second lateral part form the rotative connection and the snap-fit connection.

18. The wearable device of claim 10, wherein the press-fit protrusion is an arc-shaped surface and a flat surface and a first orthographic projection of the press-fit protrusion onto a design surface on which the press-fit protrusion is designed is a rounded rectangle, and wherein a second orthographic projection of the flat surface onto the design surface comprises a shorter straight side of the rounded rectangle.

19. A watch strap comprising:

a first connecting strap;

a second connecting strap comprising through holes; and a fastening assembly coupled to the second connecting strap and comprising:

a rotating shaft;

a base comprising:

a first surface, wherein the first surface comprises a first snap-fit part, and wherein the first snap-fit part is a locking protrusion or a locking groove; and a second surface comprising a press-fit protrusion configured to press the first connecting strap in a passage;

a pressing plate rotatively coupled to the base by the rotating shaft and comprising:

a first lateral part, a middle part, and a second lateral part that are sequentially connected, wherein the rotating shaft passes through the first lateral part, the base, and the second lateral part, and wherein both the first lateral part and the second lateral part each are rotatively coupled to the base using the rotating shaft; and a third surface comprising a second snap-fit part and facing the first surface of the base, wherein the second snap-fit part is the locking protrusion when the first snap-fit part is the locking groove, wherein the second snap-fit part is the locking groove when the first snap-fit part is the locking protrusion, wherein the locking protrusion and the locking groove fit into each other to form a snap-fit connection, and wherein the pressing plate and the base are enclosed to form the passage;

a cover plate located on a side that is of the base and that is away from the middle part, wherein the cover plate comprises connecting holes;

a connecting column comprising a screw hole;

a screwed fitting passing through the connecting holes, connected to the screw hole, and configured to fasten the second connecting strap between the cover plate and the base; and a locating column located on the side of the base, wherein the connecting column and the locating column pass through the through holes.

20. The watch strap of claim 19, wherein the base further comprises:

a base plate comprising an edge and a fourth surface facing the middle part, wherein the press-fit protrusion is provided on the fourth surface; and a lateral plate facing away from the middle part and protruding over the edge, wherein the lateral plate and the base plate are enclosed to form a groove having an opening, wherein both the connecting column and the locating column are provided on a bottom surface of the groove, wherein the opening accommodates one end that is of the second connecting strap and that is provided with the through holes in the groove, wherein the lateral plate and the first lateral part form a rotative connection and the snap-fit connection, and wherein the lateral plate and the second lateral part form the rotative connection and the snap-fit connection.

* * * * *